United States Patent [19]

Germack et al.

[11] 4,170,960

[45] Oct. 16, 1979

[54] ADDITIVE SUPPLY AND CONTROL DEVICE

[76] Inventors: Walter F. Germack, 4194 Clay St., Geneva, Ohio 44041; William L. Smith, 584 E. Main St., Madison, Ohio 44057

[21] Appl. No.: 921,484

[22] Filed: Jul. 3, 1978

[51] Int. Cl.[2] ..... F02B 77/00

[52] U.S. Cl. ..... 123/198 A; 123/1 A; 123/25 L

[58] Field of Search ..... 123/198 A, 1 A, 25 R, 123/25 A, 25 E, 25 L

[56] References Cited

U.S. PATENT DOCUMENTS

| | | | |
|---|---|---|---|
| 1,550,967 | 8/1925 | Kelty | 123/198 A |
| 2,630,794 | 3/1953 | Baxter | 123/198 A |
| 2,769,624 | 11/1956 | Burnside | 123/25 A |
| 2,922,407 | 1/1960 | Lee | 123/198 A |
| 3,338,564 | 8/1967 | Roeder | 123/198 A |
| 3,749,376 | 7/1973 | Alm et al. | 123/1 A |
| 3,865,907 | 2/1975 | Rock | 123/25 L |
| 3,945,366 | 3/1976 | Matthews | 123/198 A |
| 4,031,864 | 6/1977 | Crothers | 123/1 A |
| 4,046,119 | 9/1977 | Perry | 123/198 A |

*Primary Examiner*—Ira S. Lazarus

*Attorney, Agent, or Firm*—Frank B. Robb

[57] ABSTRACT

There is disclosed an engine additive supply and control device, for supplying a fuel supplement in small amounts which will have many desirable effects on operation of the vehicle or apparatus which is being driven by an engine to which the additive is being supplied along with the fuel and air mixture, the quantity of supply being controlled in response to manifold vacuum conditions and flow of additive through the device being controlled by passage way, opening and fluid line sizes, in the device, which are coordinated to prevent surging, flooding and to minimize consumption, while providing adequate quantities to produce the desired interaction with the fuel/air mixture, a container, a body with suitable wells and passages and interconnections being provided.

9 Claims, 3 Drawing Figures

ADDITIVE SUPPLY AND CONTROL DEVICE

OBJECTS OF THE INVENTION

It is a principal object of this invention to provide a fuel additive supply device, which is arranged to minimize the consumption of the additive, provide it at the proper time in the operation and cycle of an engine which avails of fuel and air mixture for combustion and operation, the supply being furnished with the fuel and air and the device having elements which coordinate the quantity and are responsive to conditions both in the atmosphere surrounding the engine and in the actual operational demands of fuel therein.

A further object of the invention is to provide a device which is of simple construction having a container and a control section adjoining the same, with the manifold vacuum of the engine creating the necessary movement of the additive in the container through the control section thereof in response to demands of power and limiting the same however to small quantities which will be effective and not too expensive.

Another object of the invention is to provide a device in which a container is arranged adjacent a well body in which are provided a series of wells and passages to which and through which the additive within the container is supplied and fron which body it is delivered to a manifold vacuum portion area which is that through which the fuel/air mixture is passing and in which the additive is mixed to carry out its intended purpose.

Other and further objects of the invention will be understood from a consideration of the specification appended hereto and disclosed in the drawing wherein.

DESCRIPTION OF THE INVENTION

Figure 1:
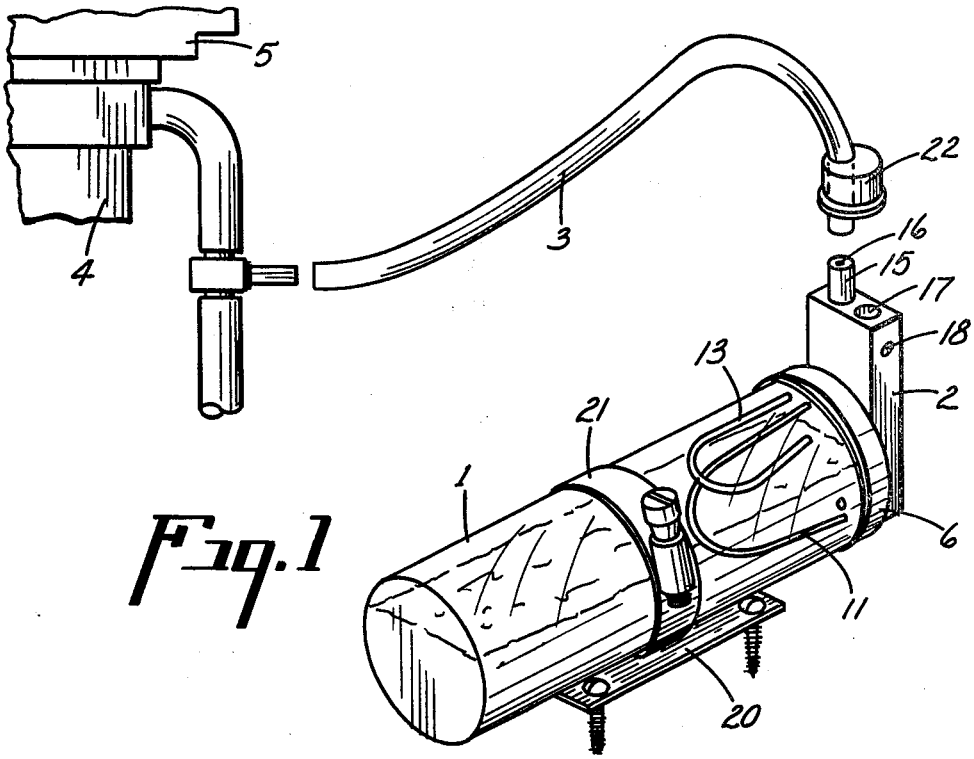
FIG. 1 is a perspective view, somewhat fragmentary, illustrating generally the relationship of the device and its essential elements with a fragmentary portion of an engine particularly and specifically the carburetor and manifold section thereof.

In FIG. 1, the device is shown as comprising a container generally designated 1 having at one end a control body 2, from which extends a supply line 3 to a carburetor area and specifically a manifold 4 of an engine not disclosed completely but well within the scope of one skilled in the art to supply, a carburetor suggested in fragmentary portion at 5.

The container 1 is intended to supply and contain therewithin a suitable additive which has certain desirable functions in connection with an internal combustion engine such as is contemplated to be supplied and furnished with usual fuel and in addition the additive is controlled by the device hereof.

Generally speaking the additive may be a petroleum product as an example, a particularly effective concentrate known as MXO produced by Bell Laboratory, Inc. of Orland, Florida has been found most suitable for use in this connection and the device hereof is adequately designed to handle such material in the form of additive, and in liquid specifically which involves a specific gravity at 60 degrees F. of 0.805, a density (pounds/gallon) at 60 degrees F., of 6.71 and a viscosity (CPS) at 100 degrees of 1.182.

With the foregoing in mind, detailed consideration of the drawings discloses that the container 1 in this instance is an elongated cylindrical transparent container preferably formed of natural polypropylene, having a threaded area at its open end adapted to receive a cap member 6 for sealing connection of such end, the cap member 6 in turn being equipped with a control or well body previously indicated as 2, which will now be described in detail.

Figure 2:
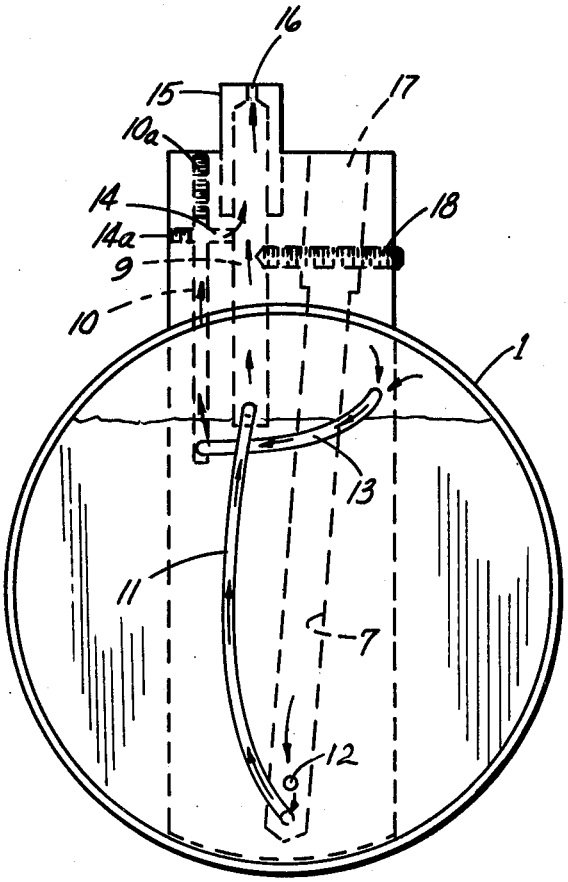
FIG. 2 is an enlarged view partly in section, and somewhat diagramatic illustrating the various elements and passageways and their relationship with flow indicated thereon as respects the additive liquid or fluid.
Figure 3:
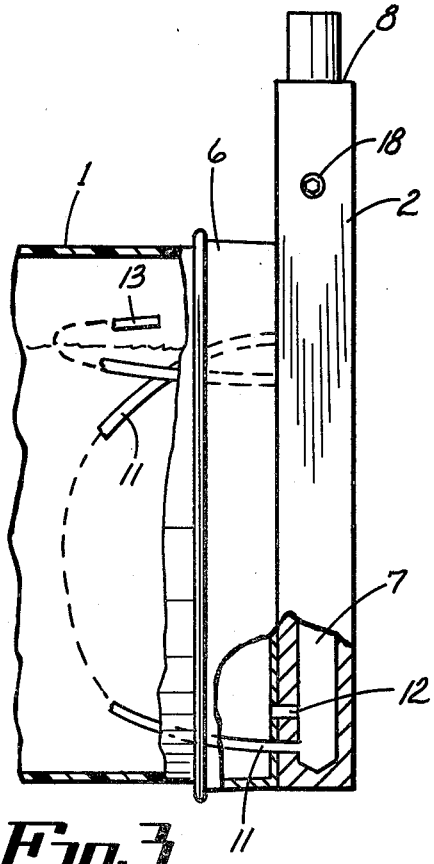
FIG. 3 is a fragmentary view, partly in section further illustrating the various elements and passages with their relationships.

Referring to the FIGS. 2 and 3, the well body 2 is shown as having arranged generally vertically therewithin the atmospheric well 7, which extends upwardly to the upper end 8 of said well body 2, and at its lower end terminates at position substantially at the lowermost portion of the container 1, the body 2 being maintained in substantially vertical position with the container 1 horizontally related thereto.

The well body 2 in addition to the atmospheric well 7, includes what is designated as a fluid lift well 9, likewise vertically arranged in the body 2 and spaced from the well 7 previously mentioned.

A third well described as an evacuator well and designated 10 is likewise formed in the body and also arranged substantially vertically therein being of less vertical extent than the atmospheric well 7 as is also the fluid well 9.

The fluid lift well 9 is connected to the atmospheric well 7 by a tubular member 11, having an interior diameter of about 0.026 inches preferably, with the usual tolerances provided therefor, so that the lower most portion of the well 7 as indicated in FIG. 1 being provided with an opening from which the tube 11 extends, and the well 9 correspondingly is connected to this tube at its lower most portion likewise.

The atmospheric well 7 is supplied with fluid from the additive chamber in the container 1 through an opening 12 leading into the interior of said well 7 from the container so that the liquid may flow into said well.

The container is intended to be evacuated above the liquid contained therein from the evacuator well 10 by means of a tube 13 having a passageway therein of the same diameter as the passageway of the tube 11, namely 0.026 of an inch.

The well 10 in this instance is connected by passage 14 which extends from the evacuator well 10 the fluid lift well 9. The passages 10 and 14 may be formed by usual machining operations, the end portions 10*a* and 14*a* being subsequently suitably sealed.

The fluid lift well 9 is provided at its upper end with an orifice member 15, in which an orifice 16 is formed, and said orifice member 15 being adapted to receive thereover, the tube 3 so that it will transfer the liquid to the manifold in a manner to be subsequently described, the vacuum in the manifold being impressed upon the various members or elements just described by means of the tube 3, vacuum effective through the orifice 16, causing the evacuator well 10 to initially evacuate the area in the container 1 above the liquid therewithin and maintaining said evacuated condition during the operation of the engine which is being supplied with the additive hereunder consideration.

It should be noted that the well 7 is open to the atmosphere as suggested at 17.

Means to regulate the evacuation of the evacuator well, are only dependent upon the vacuum created in the manifold, whereas the supply of additive from the container 1 is regulated by a regulating means in the form of a set screw 18 extending through the body 1 from a position as suggested in FIGS. 2 and 3.

The various positions of the openings and connections of the respective tubes involving the passageways therewithin, are quite important and in fact critical in this construction, it being noted that the distance from the regulating means 18, to the opening 12 is not less than 2¼ inches, and for this device, preferably not more than 3½ inches.

With these proportions, it has been found that by reason of the sizes of the passageways and this arrangement that surging of the liquid in the container is obviated, and flooding of the liquid can be prevented, the evacuation of the area above the additive being essential likewise.

It is important to note that the position and level of the opening 12 determine and precisely maintain the fluid level in the atmospheric well 7, irrespective of the fluid level in the container 1. These conditions in effect meter the flow of an additive under varying atmospheric and temperature conditions from varying causes such as altitude and time of year as well as any other conditions which are not common or even common conditions likewise not specifically enumerated.

The evacuation of the container above the fluid by the evacuator tube 10 provides the desired stability and uniformity of flow. This contrasts with other metering devices in which the level varies, and the flow likewise, where external conditions are such that regulation by valves is not adequate, and flow variation therefore takes place.

It is notable and emphasized that the container 1 is of transparent configuration so that fluid level may be observed but the level is not critical between the evacuating end of the tube 13 and opening 12, as to height of the liquid in the container since the conditions are maintained to provide for uniform supply by the various proportions and sizes heretofore mentioned and described in detail.

It is also noted that the lengths of the tubes comprising the members 13 and 11 will usually be about 6 inches, to provide for the most satisfactory operation as has been determined in this particular device.

The substantially equal lengths of the tubes 11 and 13 has been found to assist in uniformity of flow, even though liquid height in the container varies between fillings thereof.

It is further noted that the container 1 and body 2 are supported suitably on a mounting plate such as 20 by a means of a clamp element 21 which may be loosened to permit the container 1 to be removed and filled as occasion demands.

The proportions and areas noted, provide in this instance for a supply of 1 ounce of additive to 10 gallons of fuel in the conditions disclosed, and under all conditions to which the engine and its associated areas will be subjected.

It is apparent that the cap member 6 is in sealed engagement with the container 1 at all times in operation to permit the evacuation therewithin and the various passageways are sealed with regard to one another to permit and provide for the flow of liquid in accordance with the demands, the engine in most instances providing it is in good shape, at idle, a vacuum measured in mercury of 18 to 20 inches, and under cruise conditions at 50 miles an hour of 14 to 16 inches, at which time the 1 ounce additive to 10 gallons of fuel is supplied.

At idle, the mixture is not necessary and is therefore not supplied as controlled by proportions heretofore mentioned and obviously by the initial adjustment of the regulating means 18.

A suitable dust cover such as 22 may be provided on the tube 3, so that when the same is in place connected to the orifice member 15 it will likewise cover the opening of the atmospheric well 7.

It is noted that the provision of the evacuator tube, and the arrangement of the connection of the atmospheric well to the atmosphere, under certain conditions might cause a flooding, and overflow of the liquid through the atmospheric well, when the engine is stopped and the heat under the hood or in the area of the device, is of such a nature as to cause expansion which would provide for such overflow or flooding.

Under these conditions, it has been found that the provision of the evacuator tube 13, is adequate of offset any tendency to flood or overflow, and the length of said tube and its size are calculated to provide enough resistance to flow so that flooding through the atmospheric well will not take place.

It will be noted of course that the opening 12 at the lower end of the atmospheric well, it adequate to balance the fluid levels in the well with the level in the container, as will take place but normally during operation, the height of fluid in the atmospheric well 7 is substantially lower than the height of the fluid in the container.

We claim:

1. In combination with an engine operating on fuel/air mixture passing through a manifold in which a vacuum is developed, a device for supplying an additive from a source of supply, to the mixture in response to such vacuum comprising a container for such additive, a well body to receive additive from said container, a series of wells extending generally vertically in said body, one of said wells constituting an atmospheric well connected by an opening to receive additive at the lower portion of the container, the said well being open to the atmosphere at the upper end, a fluid lift well in the body, a passageway connecting the lower ends of the wells aforesaid, the lift well being connected by a fluid line to the said manifold, an orifice in the fluid line leading to the manifold, means to regulate the flow of additive from the lift well to the orifice, an evacuator well in the body, a passage connecting the evacuator well to the fluid lift well intermediate the regulating means and the orifice, a passageway extending from the evacuator well into the interior of the container, said passageway having an open end normally above additive in the container, said container being thereby evacuated above adequate additive therein by vacuum developed during operation of the engine, additive likewise being supplied to the manifold by such vacuum through the fluid lift well.

2. A device as claimed in claim 1, wherein the means to regulate the flow of additive is at a distance not less than about two and one-quarter inches above the opening by which the additive is supplied to the atmospheric well.

3. A device as claimed in claim 2, wherein the distance is not less than between about 2¼ and 3½ inches.

4. A device as claimed in claim 1, wherein the passageways are hollow tubular members having the same open cross-sectional area.

5. A device as claimed in claim 1, wherein the passageways are hollow tubular members having the same open cross-sectional area, and the orifice is likewise of substantially the same cross-sectional area.

6. A device as claimed in claim 4, wherein the tubular members are of substantially the same length.

7. A device as claimed in claim 4, wherein the tubular members are of substantially the same length and on the order of twenty-four thousandths inches interior diameter.

8. A device as claimed in claim 1, wherein the container is elongated and is supported in a substantially horizontal position, said container having the well body mounted at one end in sealed relation to confine a liquid additive in the container, the well body being generally vertically disposed as stated, the atmospheric well extends upwardly in the body at about right angles to the axis of the container, the opening from the container to the atmospheric well supplying additive to the said well, and the passageway from the atmospheric well extending from below the said opening, to a point in the fluid lift well, substantially higher in the well body.

9. A device as claimed in claim 8, wherein the opening from the container to the atmospheric well is on the order of seventy-three thousandths inches in diameter.

* * * * *